United States Patent [19]

Hillberg et al.

[11] 4,400,900

[45] Aug. 30, 1983

[54] MULTI-BARREL HANDGUN FIRING MECHANISM

[76] Inventors: Robert L. Hillberg, P.O. Box 813, Cheshire, Conn. 06410; Frederick F. Stevens, 177 Brett Rd., Fairfield, Conn. 06430

[21] Appl. No.: 308,383

[22] Filed: Oct. 2, 1981

[51] Int. Cl.[3] ..... F41C 19/00

[52] U.S. Cl. ..... 42/69 R; 42/42 B

[58] Field of Search ..... 42/8, 69 R, 42 R, 42 B

[56] References Cited

U.S. PATENT DOCUMENTS 1,348,035 7/1920 Mossberg ..... 42/8

*Primary Examiner*—Charles T. Jordan
*Assistant Examiner*—Ted L. Parr
*Attorney, Agent, or Firm*—McCormick, Paulding & Huber

[57] ABSTRACT

A double action multi-barrel handgun has a hammer assembly which includes a hammer and a rotary firing element carried by the hammer. The firing element is retained in assembly with the hammer by a detent mechanism which continuously urges the firing element into face-to-face engagement with the hammer whereby to eliminate play between the firing element and hammer.

11 Claims, 6 Drawing Figures

MULTI-BARREL HANDGUN FIRING MECHANISM

BACKGROUND OF THE INVENTION

This invention relates in general to firearms and deals more particularly with a multi-barrel handgun having an improved double action firing mechanism.

A handgun of the type with which the present invention in concerned has a barrel assembly which includes a plurality of barrels, each having an associated chamber. The firing mechanism comprises a trigger and a hammer assembly which includes a pivoted hammer and a rotary indexible firing element carried by the hammer. Drawing back on the trigger pivots the hammer to a tripping position against the biasing force of a mainspring, indexes the firing element to align it in a firing position relative to an associated one of the chambers, and releases the hammer at its tripping position to pivot to a striking or firing position, under the biasing force of the mainspring, to engage an associated firing pin, where the firing mechanism is arranged for center fire, or the rim of an associated cartridge, where the mechanism is arranged for rim fire, to fire a cartridge seated in the associated chamber.

The firing element is supported for rotation relative to the hammer by a shaft which projects from the firing element and is received within a bore in the hammer. The firing element is held in assembly with the hammer by a retaining ring or spring washer which is engaged with a projecting end of the shaft. Such a hammer assembly is difficult and costly to assemble and may result in excessive clearance or axial play between the hammer and firing element. When such clearance or axial play is present in the hammer assembly a double striking condition may occur, that is the firing element may engage an associated firing pin, or the rim of an associated cartridge, before this play is taken up by the front or striking face of the hammer engaging an associated rear face of the firing element. This condition results in substantial reduction in the potential force of the hammer blow. In a small handgun of the hammerless type, wherein the hammer is wholly concealed within the gun frame and hammer travel is severely restricted, this loss of striking force may be sufficient to cause misfire. The present invention is concerned with the aforesaid problems.

SUMMARY OF THE INVENTION

The invention resides in an improved firing mechanism for a handgun which has a frame and a hammer assembly supported on the frame for pivotal movement between tripping and striking positions and which includes a hammer, a firing element journalled for indexible axial rotation on the hammer means, for retaining the firing element in assembly with the hammer, biasing means for normally urging the hammer toward its striking position, and a trigger supported on the frame for movement between ready and firing position. The hammer assembly is moved to a tripping position in opposition to the biasing force of the biasing means and is released in the latter position by moving the trigger from its ready to its firing position.

In accordance with the invention, the retaining means comprises means within the hammer for releasably retaining the firing element in assembly with the hammer and for biasing the firing element in an axial direction toward the hammer to maintain a striking face of the hammer in engagement with an associated face of the firing element whereby to eliminate axial play between the firing element and the hammer.

DETAILED DESCRIPTION OF PREFERRED EMBODIMENTS

Figure 1:
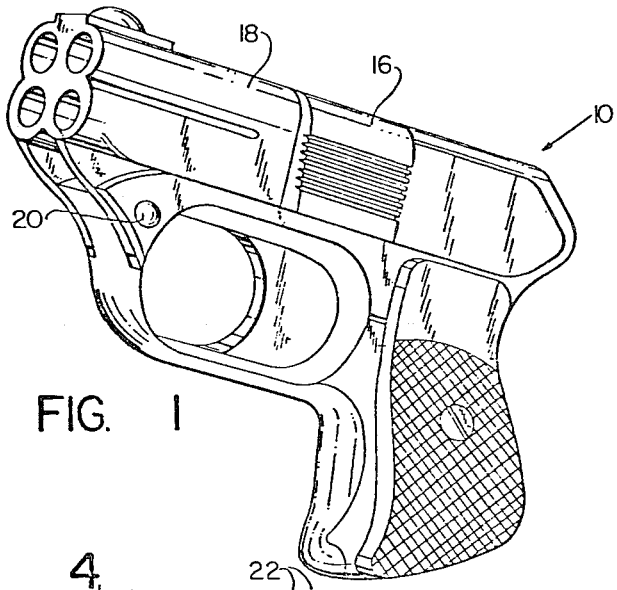
FIG. 1 is a perspective view of a four-barrel handgun embodying the present invention.
Figure 2:
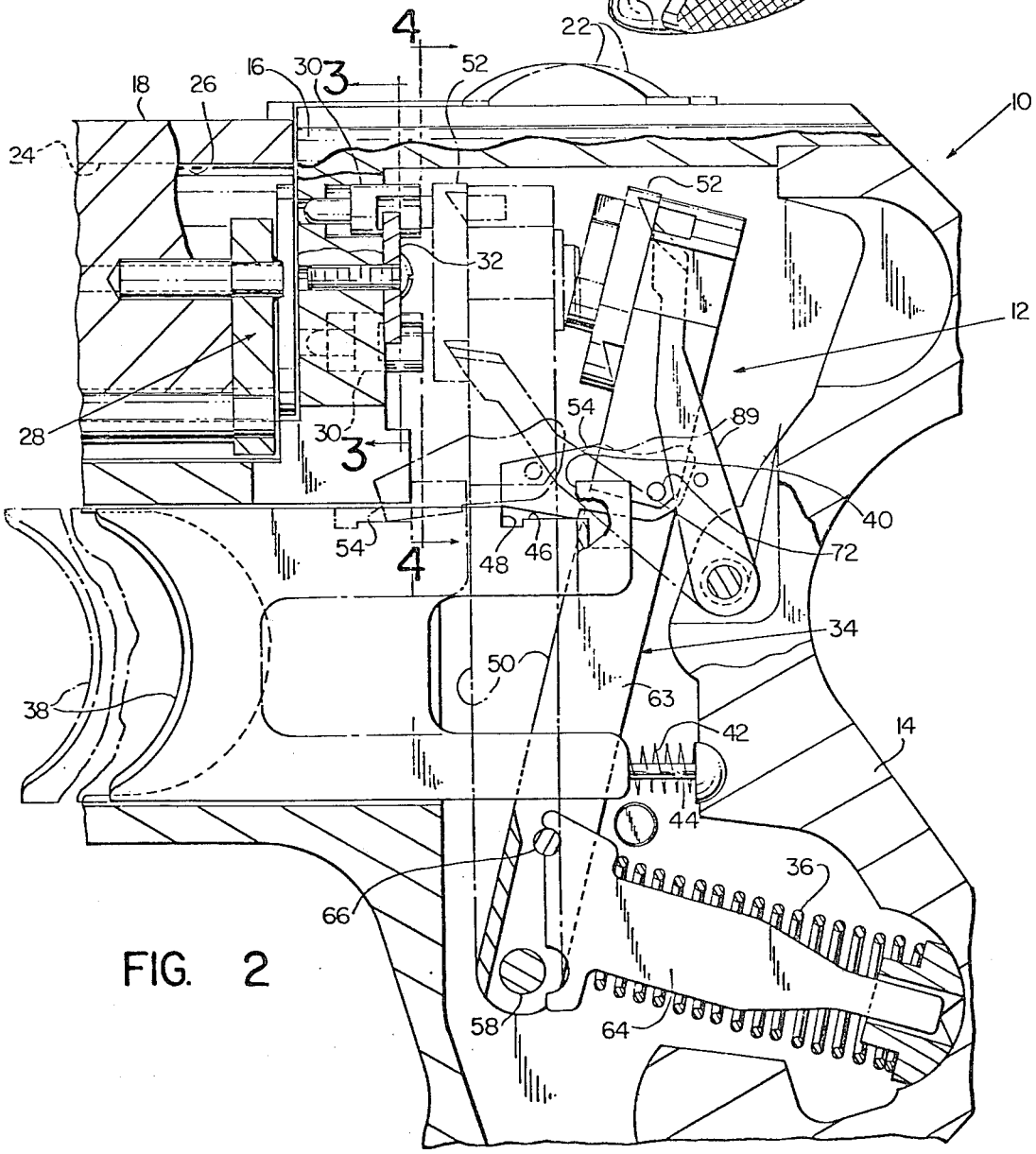
FIG. 2 is a somewhat enlarged fragmentary longitudinal sectional view through the gun of FIG. 1.
Figure 3:
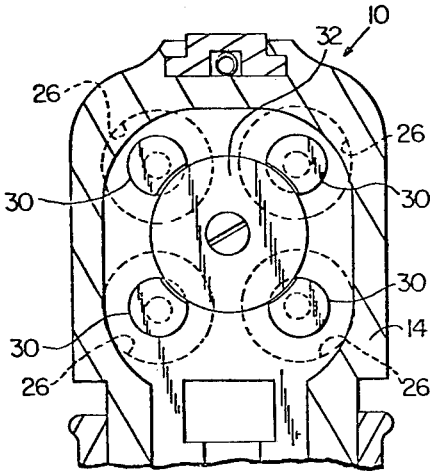
FIG. 3 is a fragmentary sectional view taken along the line 3—3 of FIG. 2.

Turning now to the drawings and referring first particularly to FIGS. 1 through 4, a multi-barrel, breech loaded handgun or pistol, indicated generally at 10, has an improved firing mechanism embodying the present invention and designated generally by the numeral 12 in FIG. 2. The illustrated firing mechanism is of the double action type capable of moving a hammer to and releasing it in a tripping position to fire the gun in response to a single pull of a trigger. Pressure on the trigger must be released after each shot is fired to enable the firing mechanism to engage for the next shot.

The pistol 10 generally comprises a frame 14 which has a breech portion 16. A barrel assembly 18 is pivotally supported at the forward end of the frame by a hinge pin 20 to break upwardly and away from the breech portion 16 upon rearward movement of a releasing latch indicated at 22 and associated with the pistol rear sight. The illustrated barrel assembly 18 has four integral barrels, best shown in FIG. 1. Each barrel has a bore 24 which includes a chamber 26 at its breech end. The chambers are closed by the breech portion 16 when the barrel assembly is latched in its closed position relative to the frame, as it appears in FIG. 1. An extractor mechanism indicated generally at 28, which comprises part of the barrel assembly 18, operates in a manner well known in the art to extract spent cartridges from the chambers 26, 26 when the barrel assembly 18 is broken upwardly to a substantially fully open position relative to the frame 14.

The illustrated pistol 10 is arranged for center fire and has four inertia firing pins 30, 30, which comprise part of the firing mechanism 12. The firing pins are received within associated bores in the breech portion 16 and retained for limited sliding movement therein by a retaining washer 32 which engages a rearwardly facing shoulder on each firing pin. Each firing pin has a forwardly projecting nose coaxially aligned with an associated chamber 26 and is adapted for striking engagement with the primer of a chambered round when the firing pin is struck and driven forward to its firing positon.

The firing mechanism 12 further includes a hammer assembly indicated generally at 34, a mainspring 36, and a trigger 38. The trigger is slidably supported in opposing upper and lower ways formed in the way frame 14 for movement between a ready position and a firing position, as will be hereinafter further discussed. The rear portion of the trigger is bifurcated and has an upwardly extending lug on its upper bifurcation which defines a forwardly facing abutment surface 40 for engaging a rearwardly facing abutment on the frame 14 to limit forward travel of the trigger 38. A trigger spring assembly which includes a trigger spring 42 and a spring guide rod 44 is received within a rearwardly opening bore in the lower bifurcation and acts between the trigger 38 and the frame 14 to normally bias the trigger in a forward direction toward its inactive or ready position shown in full lines in FIG. 1 and in broken lines in FIG. 2. An upwardly opening sear notch 46 in the upper bifurcation, forward of the abutment surface 40, is partially defined by a rearwardly facing bearing surface 48.

Figure 4:
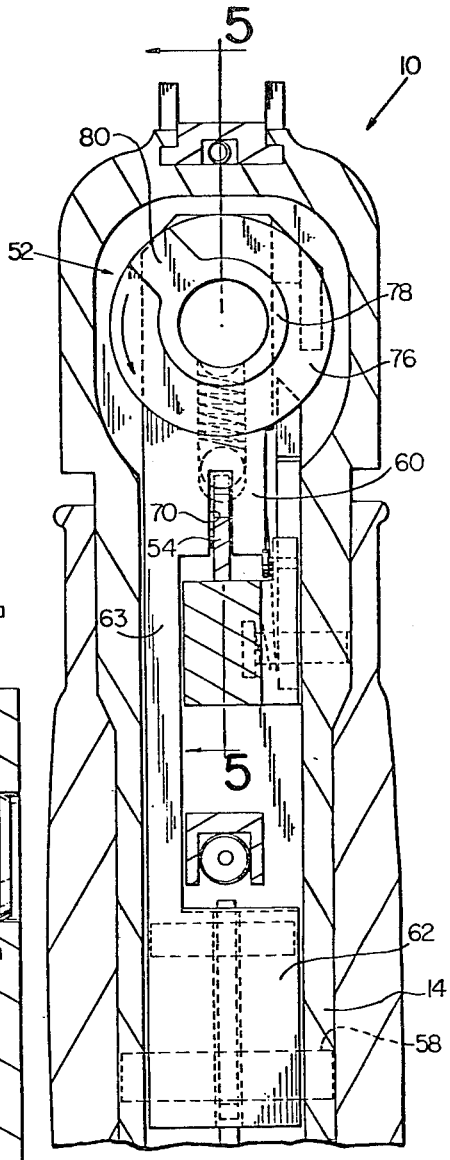
FIG. 4 is a fragmentary sectional view taken along the line 4—4 of FIG. 2.
Figure 5:
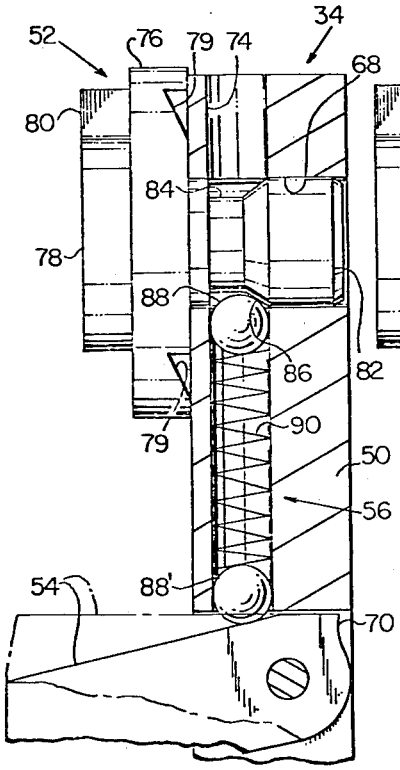
FIG. 5 is a somewhat further enlarged fragmentary side elevational view of the hammer assembly, the hammer being shown in section taken along the line 5—5 of FIG. 4.

Considering now the hammer assembly 34 in further detail and referring particularly to FIGS. 2, 4 and 5, the hammer assembly generally comprises a hammer 50, a firing element, indicated generally at 52, and a sear 54 carried by the hammer. In accordance with the invention an improved retaining mechanism, designated generally by the numeral 56 and best shown in FIG. 5, is provided for maintaining the firing element 52 in assembly with the hammer 50 and for eliminating play between these two parts. The mechanism 56 also serves to normally bias the sear 54 toward its trigger engaging position, as it appears in full lines in FIG. 5.

The hammer 50 comprises an elongated member pivotally supported at its lower end on a pivot pin 58, best shown in FIG. 2, which extends transversely of the gun frame. The hammer has transversely enlarged upper and lower end portions, respectively indicated at 60 and 62, and integrally joined by a connecting portion 63 which is disposed generally adjacent one side of the gun frame, as best shown in FIG. 4. A rearwardly opening slot in the lower portion 62 receives the forward end of a strut 64 associated with the mainspring 36. Another pin 66 mounted in fixed position in the lower end portion 62 and extending transversely of the slot is engaged by the upper end of the strut 64, as best shown in FIG. 2.

A cylindrical bore 68 extends through the hammer upper part 60, as best shown in FIG. 5. A downwardly opening slot 70 formed in the upper portion 60 receives the sear 54 which is supported on a pivot pin 72 carried by the hammer 50. Another bore 74 extends through the upper part 60 longitudinally of the hammer 50, communicates with the sear receiving slot 70, and intersects the bore 68, as best shown in FIG. 5.

The firing element 52 has a generally cylindrical disc-shaped body portion 76 and an integral annular central portion 78 which projects forwardly from the body portion. A plurality of equiangularly spaced ratchet notches 79, 79 open outwardly through the rear surface of the body portion 76. The firing element 52 further includes a firing lug 80 which extends radially outwardly from the central portion 78, as best shown in FIG. 4. The firing element 52 is supported on the hammer by an integral hub shaft 82 which projects rearwardly from the body portion 76 and is received within the bore 68. The shaft 82 is cylindrical and has a radially outwardly opening annular groove 84 which is partially defined by a generally frustoconical forwardly facing surface 86.

The firing element 52 is releasably retained in assembly with the hammer 50 by the retaining mechanism 56 which is disposed within the hammer 50 and which also serves to bias the firing element 52 in an axial direction and into face-to-face engagement with the front or striking face of the hammer whereby to eliminate axial play between the firing element and the hammer. The mechanism 56, which also serves to normally bias the sear 54 toward its hammer engaging position, comprises two balls 88 and 88' received within the bore 74 and a spring 90 disposed within the bore between the balls 88 and 88' and urging the balls in opposite directions. The groove 84 is so dimensioned that the ball 88 engages the frustoconical surface 86 in spaced relation to the inner surface of the groove 84. Thus, the ball 88 cooperates with the surface 86 to continuously urge the firing element 52 rearwardly relative to the hammer so that the rear surface of the body portion 76 is engaged in face-to-face relation with the front or striking face of the hammer 50.

A hand or pawl 89 is pivotally supported on the frame 14 and biased in counterclockwise direction and into engagement with the rear surface of the firing element 52, as shown in FIG. 2. The pawl 89 is arranged to sequentially engage the notches 79, 79 to index the firing element 52 each time the hammer moves toward its tripping position, as will be hereinafter further discussed.

Further disclosure of a ratchet or firing element and pawl mechanism and a strut-mainspring mechanism, such as hereinbefore disclosed, is contained in the copending United States patent application of Robert L. Hillberg, for MULTI-BARREL PISTOL, Ser. No. 111,870, filed Jan. 14, 1980. The latter application is hereby adopted by reference as part of the present disclosure.

When the trigger 38 is in its ready position, as it appears in full lines in FIG. 1 and in broken lines in FIG. 2, the hammer assembly 36 is in its forward or broken line position of FIG. 2, the firing element 52 is engaged with the firing pin retaining washer 32 and the firing lug 80 is aligned with an associated firing pin 30. In the latter position, the sear 54 is biased into engagement with the rear notch 46 by the mechanism 56. Drawing back on the trigger 38 causes the hammer assembly 34 to pivot in a clockwise direction about the pivot pin 58, against the biasing force of the mainspring 36, as viewed in FIG. 2. The pawl or hand 89 which is biased into engagement with an associated one of the ratchet notches 79, 79 also pivots in a clockwise direction, as viewed in FIG. 2, to index the firing element 52 in a counterclockwise direction, as viewed in FIG. 4, and move the firing lug 80 into firing alignment with another of the firing pins. The retaining mechanism 56 acts as a drag brake on the shaft 82 to retain the firing lug 80 in proper indexed alignment with an associated firing pin.

When the trigger 38 reaches its firing positon, indicated in full lines in FIG. 2, which corresponds to the tripping position of the hammer assembly 34, the sear 54 is released from engagement with the trigger 38 by coengageable cam surfaces on the sear and the trigger thereby allowing the hammer assembly 34 to pivot in counterclockwise direction to its firing position, as viewed in FIG. 2, under the biasing force of the mainspring 36.

Since the retaining mechanism 56 retains the firing element 52 in face-to-face engagement with the hammer 50, the hammer and the firing element move simultaneously as a unit to firing position so that the full inertia of the moving mass which comprises the hammer and the firing element is absorbed by an associated firing pin engaged by the lug firing 80.

As previously noted, after the gun 10 has been fired, the trigger 38 must be released to reset the mechanism to fire the next shot. Releasing the trigger allows it to return to its ready position under the biasing force of the trigger spring 44 to position the sear notch 46 to receive the sear 54 whereby to set the mechanism for the next shot.

The firing element 52 may be readily removed from assembly with the hammer 50 by pulling forward on the firing element relative to the hammer while taking care to catch the balls 88, 88' and the spring 90 which may escape from one or the other of the bores 68 and 74. In reassemblying the firing element with the hammer the balls 88, 88' and spring 90 are first dropped into the hammer bore 74. A rod may then inserted into the hammer through the upper end of the bore 74 to hold the spring 90 in compression while the hub shaft 82 is simultaneously inserted into the bore 68. When the chamfered free end of the hub shaft 82 engages the ball 88, the rod may be withdrawn and the hub shaft fully inserted into the bore 68 to complete the assembly.

Figure 6:
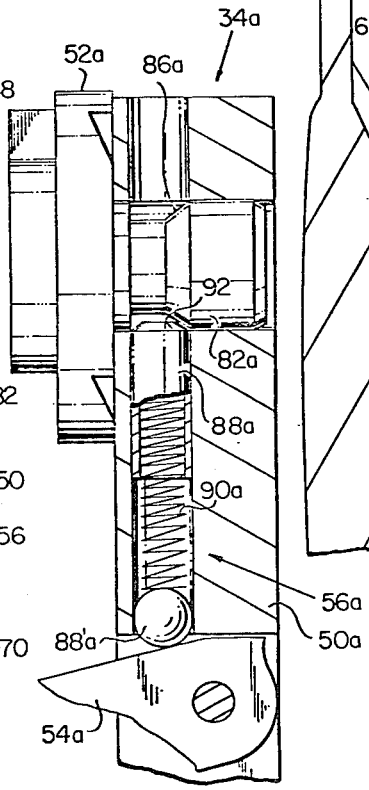
FIG. 6 is similar to FIG. 5 but shows another embodiment of the invention.

Referring now to FIG. 6, there is shown another hammer assembly embodying the present invention and indicated generally at 34*a*. Parts of the hammer assembly 34*a* which are substantially identical to parts of tBe hammer assembly 34, previously described, bear the same reference numeral and a letter "a" suffix and will not be hereinafter further described.

The hammer assembly 34*a* is similar to the hammer assembly 34 in most respects, but differs therefrom in the construction and arrangement of the retaining mechanism 56*a*. Specifically, the retaining or detent mechanism 56*a* includes a tubular member 88*a* which has a truncated upper end portion at least partially defined by a frustoconical surface designated by the numeral 92. A spring 90*a* partially received within the tubular member 88*a* acts between the latter member and a ball 88*a'* to bias the surface 92 into engagement with an associated complementary frustoconical surface 86*a* on the shaft 82*a*. The retaining mechanism 56*a* releasably retains the firing element 52*a* in assembly with the hammer 50*a* while biasing the firing element in an axial direction and into face-to-face engagement with the hammer 50*a* whereby any free play between the hammer and the firing element is substantially eliminated. The retaining mechanism 56*a* further serves to bias the sear 54*a* toward engagement with the trigger and to brake movement of the firing element relative to the hammer, as hereinbefore discussed.

We claim:

1. In a multi-barrel handgun having a frame, a barrel assembly supported on the frame and including a plurality of bores, each of the bores having an associated cartridge chamber, a hammer assembly supported on the frame for movement between tripping and striking positions and including a hammer having a bore, a firing element supported by a shaft received within the bore for indexible axial rotation on the hammer, and means for retaining the firing element in assembly with the hammer, first biasing means for normally urging the hammer assembly toward its striking position, a trigger supported on the frame for movement between ready and firing positions, means for moving the hammer from its striking position to its tripping position and releasing it in its tripping position in response to movement of the trigger from its ready to its firing position, and means for indexing the firing element to align it in firing relation to a cartridge seated in an associated one of the chambers in response to movement of the trigger toward its firing positon, the improvement wherein the retaining means includes a detent within said hammer and second biasing means for urging said detent into engagement with said shaft and comprises means for releasably retaining said firing element in assembly with said hammer and for biasing said firing element in an axial direction and into face-to-face engagement with said hammer whereby to eliminate axial play between said firing element and said hammer.

2. In a multi-barrel handgun as set forth in claim 1 the further improvement wherein said shaft has an annular groove and said detent is engaged with said shaft within said groove.

3. In a multi-barrel handgun as set forth in claim 2 the further improvement wherein said annular groove is partially defined by a rearwardly diverging generally frustoconical surface and said detent is engaged with said frustoconical surface.

4. In a multi-barrel handgun as set forth in any one of claims 1, 2 and 3 the further improvement wherein said detent comprises a spherical ball.

5. In a multi-barrel handgun as set forth in any one of claims 1, 2 and 3 the further improvement wherein said detent comprises a cylindrical member.

6. In a multi-barrel handgun as set forth in claim 5 the further improvement wherein said cylindrical member is further characterized as a tubular member and said second biasing means comprises a spring partially disposed within said tubular member.

7. In a multi-barrel handgun as set forth in claim 5 the further improvement wherein said cylindrical member has a truncated conical end portion engaged with said shaft.

8. In a handgun having a hammer assembly including a hammer having a forwardly facing striking face and a bore opening through the striking face, a firing element having a rearwardly facing surface engaging said striking face, a shaft projecting rearwardly from said rearwardly facing surface and received within the bore and supporting the firing element for indexible rotation relative to the hammer, and means retaining the firing element in assembly with the hammer, the improvement wherein said retaining means comprises a radially outwardly opening annular groove in said shaft partially defined by a forwardly facing and rearwardly diverging frustoconical surface and a detent mechanism disposed within said hammer and including a detent member engaging said frustoconical surface in spaced relation to the inner surface of said groove and biasing means for urging said detent member toward said shaft.

9. In a handgun as set forth in claim 8 the further improvement wherein said detent member comprises a spherical ball.

10. In a handgun as set forth in claim 8 the further improvement wherein said detent member comprises a cylindrical member having a truncated conical end portion engaging said frustoconical surface.

11. In a handgun as set forth in claim 10 the further improvement wherein said cylindrical member comprises a tubular member and said biasing means comprises a spring partially received within said tubular member.

* * * * *